US006523482B2

(12) United States Patent
Wingate

(10) Patent No.: US 6,523,482 B2
(45) Date of Patent: Feb. 25, 2003

(54) BULK MATERIAL TRANSPORT SYSTEM

(76) Inventor: Thomas A. Wingate, 16 Dogwood Dr., Chester, NJ (US) 07430

( * ) Notice: Subject to any disclaimer, the term of this patent is extended or adjusted under 35 U.S.C. 154(b) by 0 days.

(21) Appl. No.: 09/846,444

(22) Filed: May 1, 2001

(65) Prior Publication Data

US 2002/0162480 A1 Nov. 7, 2002

(51) Int. Cl.[7] ..... B61D 5/00
(52) U.S. Cl. ..... 105/355; 220/529
(58) Field of Search ..... 105/355, 363, 105/423; 220/507, 529, 533, 535, 544, 537; 298/1 B

(56) References Cited

U.S. PATENT DOCUMENTS

| | | | | |
|---|---|---|---|---|
| 633,530 A | | 9/1899 | Myers | |
| 842,765 A | * | 1/1907 | Byrd | 220/507 |
| 864,555 A | | 8/1907 | Randall | |
| 873,237 A | | 12/1907 | Hoffman | |
| 1,082,524 A | | 12/1913 | Holmes | |
| 1,413,751 A | | 4/1922 | McDonald | |
| 2,483,582 A | | 10/1949 | Hill | |
| 2,913,029 A | * | 11/1959 | Paton | 105/355 |
| 2,958,492 A | | 11/1960 | Maynard | |
| 3,098,567 A | | 7/1963 | Steel | |
| 3,136,425 A | | 6/1964 | Greenbury | |
| 3,278,042 A | | 10/1966 | Frydenberg | |
| 4,685,846 A | | 8/1987 | Golay et al. | |
| 5,193,710 A | * | 3/1993 | Podd et al. | 220/1.5 |
| 5,312,162 A | * | 5/1994 | Baebel | 298/1 |
| 5,567,112 A | * | 10/1996 | Balzano | 414/786 |
| 5,735,412 A | | 4/1998 | Sheckells | |
| 5,941,666 A | | 8/1999 | Waters | |
| 6,076,693 A1 | * | 6/2002 | Reiter et al. | 220/495.01 |

FOREIGN PATENT DOCUMENTS

| | | |
|---|---|---|
| EP | 0 109 191 | 5/1984 |

* cited by examiner

*Primary Examiner*—S. Joseph Morano
*Assistant Examiner*—Frantz F. Jules
(74) *Attorney, Agent, or Firm*—Carella Byrne Bain Gilfillan Cecchi et al.; William Squire

(57) ABSTRACT

A bulk material carrier in a bulk material transport system includes a high strength high density polyethylene (HDPE) flexible sheet material attached by clamps at two opposite edges to box beam supports forming a bulk material carrying sling, e.g., for carrying bales of municipal waste. The supports extend beyond the sheet material forming extensions. Rail gondola cars and truck trailers are fitted with frames which releasably secure the support extensions. Pocket members secured to the frames releasably secure the extensions and supported carrier during transport of the rail car or truck to preclude displacement of the supports and carrier horizontally. The rail car frames form four carrier receiving compartments and a truck trailer frame is arranged to carry a single carrier. The supports have fork lift truck pockets to permit the loaded or empty carriers to be transferred between rail cars and truck trailers.

22 Claims, 5 Drawing Sheets

24
46
52
40
26
28

62
78
66
70
69
24
72
71
68
64
67
13

84
86
88
90

62
64
68
74
66
67

78
82
80
83
70

BULK MATERIAL TRANSPORT SYSTEM

This invention relates to a transport system for transporting bulk material such as baled municipal waste by truck and rail car.

U.S. Pat. No. 633,530 discloses a hop bin comprising two rails to which a sack-like receptacle is attached made of a fabric. The sack comprises a long and wide body strip tacked to the sides of the rails. Head and tail pieces are sewed to the ends of the body-strip. Ropes are fastened by their ends between the rails to make the head and tail pieces taut. The rails are supported on two folding and jointed crotches. The crotches are hinged to the rails and arranged to be folded under the rails. The hop bins are carried to the fields for receiving hop vines which are lain in the bin while the hops are removed from the vines. These bins are arranged for manual carrying with handles at each end of the rails. These bins are not suitable for truck or rail transport of bulk material that weighs in the order of tons.

U.S. Pat. No. 842,765 discloses a cotton pickers sack carrier. The carrier, referred to as a truck, comprises runners at the base of the carrier beveled a the ends to permit propulsion in two opposite directions. The runners are connected by cross bars. The runners support uprights which are formed into tenons inserted into mortises in the runners. Bags are provided with slats at their upper edges with slats with notches to engage the tenons. Cross braces are provided with perforations to engage the tenons. The slats 12 have handles for suspension from hooks for weighing purposes. The filled sacks are removed by disengaging the slats and allowing the slats and bag to drop downwardly for passing of the filled sack between the uprights. The disclosed structure must be moved over the ground by means not shown via couplers at each of the opposite ends of the truck. This is a complex cumbersome and outmoded system for transporting cotton since sleds with runners would no longer be used in the place of modern vehicles. The combined carrier and runner arrangement is bulky and not readily adapted for transport in modem trucks or rail cars. A somewhat similar concept is disclosed in U.S. Pat. No. 2,483,582 which discloses a tobacco sled.

U.S. Pat. No. 864,555 discloses a liquid dispensing apparatus. The apparatus comprises a tank and a diaphragm or blanket which is locked in position in the tank. When the tank is filled with liquid, the liquid lifts the blanket.

U.S. Pat. No. 873,237 discloses a trash, mail and the like receptacle. The receptacle comprises a frame and can with a side door and a bag with a stiff frame at its upper end for sliding on a track way on the can and which is removable from one side of the can.

In U.S. Pat. No. 1,082,524, a banana shipping device is disclosed. The device comprises a collapsible frame including supporting rods pivotally secured together and a plurality of horizontal rods connecting the pivoting rods. A fabric fruit sling such as burlap is mounted on the horizontal rods. This arrangement is complex, costly to fabricate and is not adapted for carrying large weights.

U.S. Pat. No. 1,418,751 discloses a refuse receiver comprising a crate and a paper bag.

U.S. Pat. No. 2,913,029 discloses bulk transporting and storing containers for use with rail cars. The containers are not portable and are intended to remain with the rail cars. To remove the containers from the rail car, they can be collapsed. The container includes a moisture impervious bag of plastic sheet material and the like. The bag has a cover with an entrance. The bag can be turned inside out for cleaning. A collapsible bag supporting framework is provided for the bag. The bag and framework are not designed for lifting the loaded bag from the rail car.

U.S. Pat. Nos. 2,958,492, 3,136,425, 3,278,042, 4,685,846, 5,193,710 and 5,735,412 disclose still other racks and transport arrangements for different kinds of goods.

The present invention is a recognition of a need for a low cost bulk material transport system. It is recognized that gondola rail cars are relatively low cost and widely available. However, present bulk material shipping containers are all metal and costly. Typically such containers cost in the range of about $6000 to $10000 each. The containers are also relatively heavy and have a net weight of about four tons. Such containers can comprise about 15 to 20% of the weight carried by the rail cars, which is excessive. Further, not all facilities are served by rail. Therefore, trucks need to be used in certain facilities. The containers need to be transferred sometimes between rail and trucks. The relatively large weight of the containers thus reduces the total weight of bulk material that can be carried by a truck. The present invention is directed to a solution to these problems.

A bulk material transport system for transporting bulk material in at least one transport vehicle according to the present invention is light weight and low cost relative to present containers in use. The system is also flexible in that it is adapted to transport material by rail and truck. The system of the present invention comprises at least one carrier supporting frame adapted to be permanently secured to the at least one transport vehicle; and a bulk material carrier for receiving bulk material to be transported by the at least one transport vehicle. The carrier comprises a pair of elongated supports, each support having opposing first and second ends for mounting on the at least one frame, and a flexible sheet material forming a sling having opposing edge regions, the supports being secured to the sling at the opposing edge regions, the ends of the supports and support frame being arranged to releasably mate for releasably securing the carrier sling suspended in fixed position to the frame to preclude horizontal displacement of the secured supports relative to the at least one frame during transport of the loaded carrier.

In one aspect, the at least one vehicle comprises a rail car and a truck each having a cargo receiving body, the at least one support frame comprising a first frame for attachment to the rail car body and a second frame for attachment to the truck cargo body, the frames being arranged to receive and secure the same supports and secured sling.

In a further aspect, the first and second frames are different.

In a further aspect, the supports are hollow beams having a first length, the sling having a second length shorter than the first length, the supports for protruding beyond the carrier at each the ends for releasable mounting on the at least one frame at each the ends.

In a still further aspect, the supports have the same end configuration, the frames including a pocket member mating with and for receiving the end configuration of the supports to preclude the horizontal displacement of the carrier.

Preferably, the frame comprise a cross member for receiving thereon the ends of the supports and for supporting the ends by the force of gravity, further including an element protruding from the cross member for receiving at least a portion of the support ends and for restraining the supports from displacement in a horizontal plane.

The element may comprise a U-shaped member having a plurality of sides forming a pocket for receiving mating engaged end of a support.

In a further aspect, the element comprises one of a projection extending from the cross member and aperture in the cross member, the ends each having the other of the projection and aperture for receiving and engaging the projection vertically.

In a further aspect, the supports comprise tubular members with planar sides normal to adjacent sides, a plate, and a plurality of fasteners for attaching the plate to one of the planar sides with the sheet material of the sling sandwiched between the plate and the one side.

In a further aspect, the at least one transport vehicle comprises a rail car, the frame comprising a plurality of spaced cross members on which the ends of the supports can be mounted for dividing the rail car into a plurality of carrier receiving compartments, each compartment for receiving a different corresponding bulk material carrier.

Preferably the at least one carrier supporting frame is arranged for dividing the rail car into four compartments, each for independently receiving a bulk material carrier.

In a further aspect, the first and second frames each include a cross member having an identical support receiving element for restraining the horizontal displacement of the received support.

Preferably, the supports each have a pair of pocket members for releasably receiving a fork lift vehicle lift member to lift the carrier off of the at least one frame.

In a further aspect, the sheet material forming the sling is high density polyethylene having a tensile strength of about at least 250 lb/in$^2$.

In a still further aspect, the carrier and frame are arranged to carry about 50,000 lb. of bulk material.

IN THE DRAWING

Figure 3:
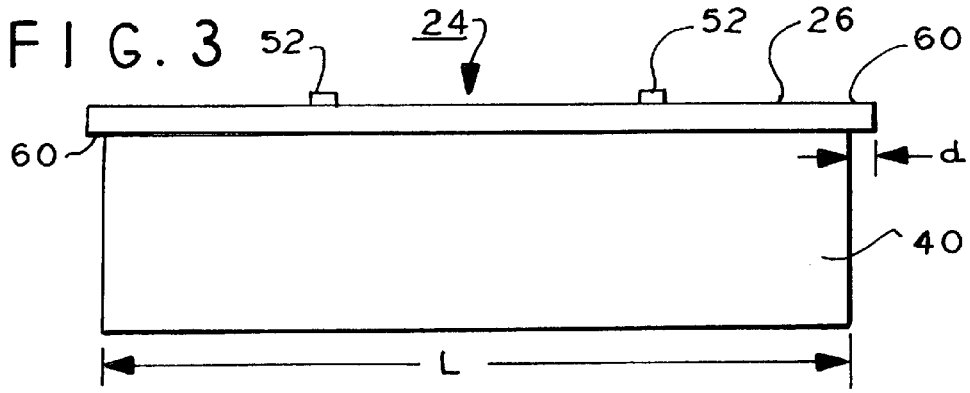
FIG. 3 is a side elevation view of a portable bulk material carrier according to an embodiment of the present invention.
Figure 4:
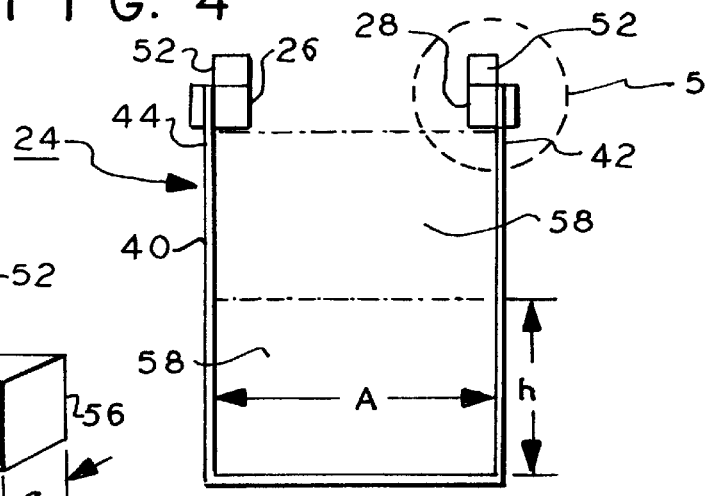
FIG. 4 is an end elevation view of the bulk material carrier of the embodiment of FIG. 3.
Figures 10, 11, 12, 13, 14:
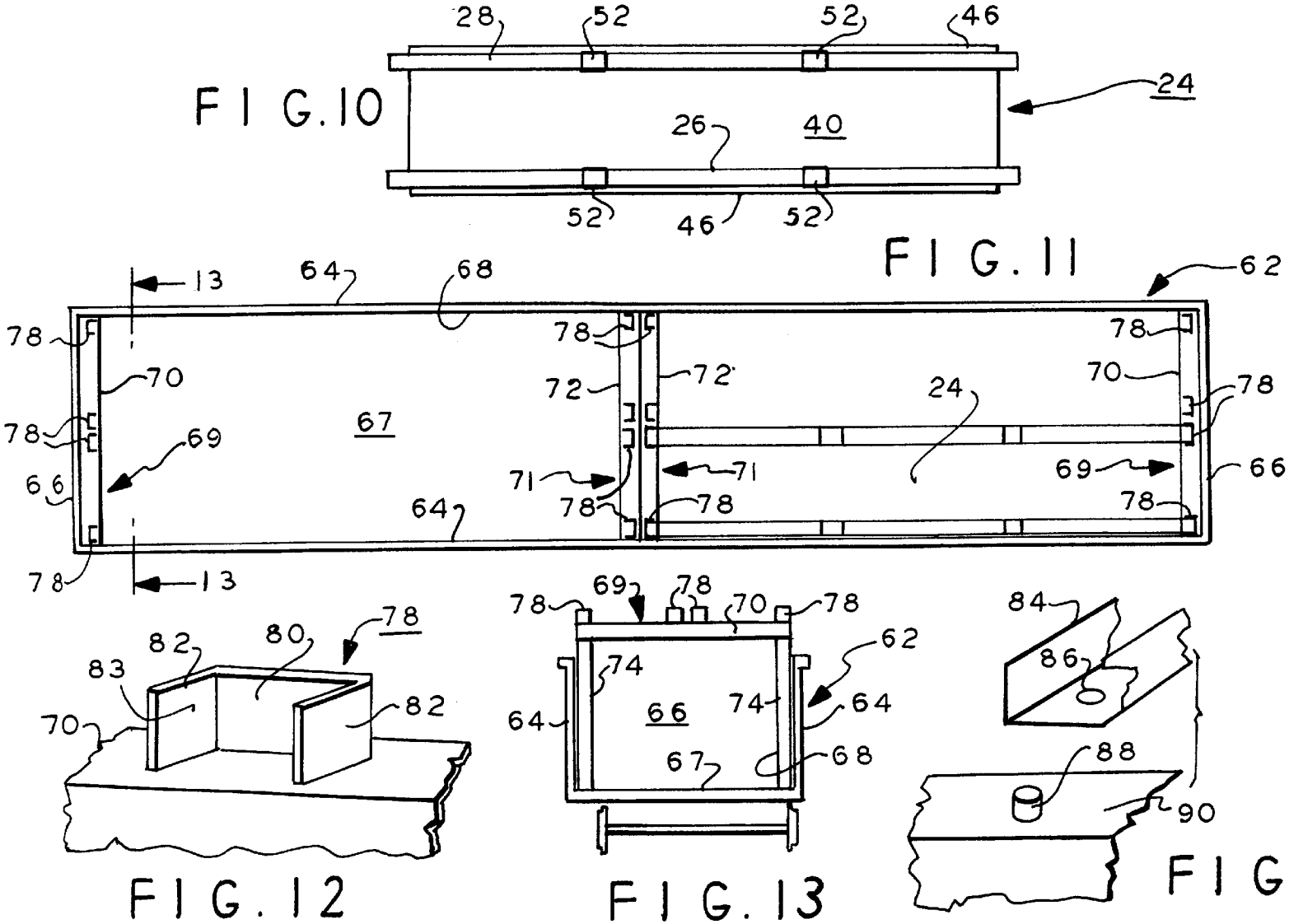
FIG. 10 is a top plan view of the bulk material carrier of FIGS. 3 and 4.
FIG. 11 is a top plan view of the rail car of FIG. 9 without the lid and with a carrier of FIGS. 3, 4 and 10 installed.
FIG. 12 is an isometric view of a representative securing pocket member of a first embodiment employed on the rail car of FIG. 11 or other transport vehicle for securing a carrier support and its associated sling horizontally in place during transport of the loaded carrier.
FIG. 13 is a sectional elevation view of the rail car of FIG. 11 taken along lines 13—13.
Figure 15:
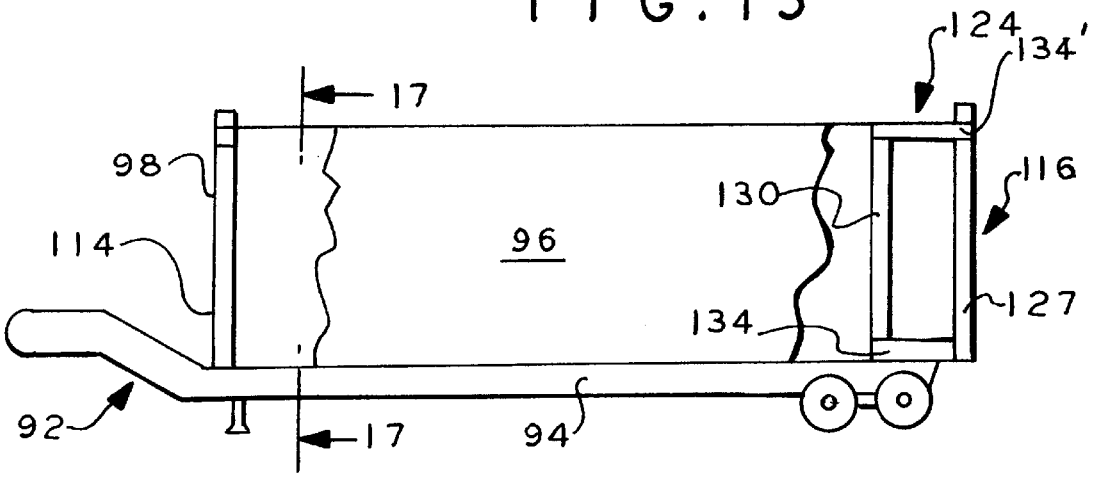
Figure 16:
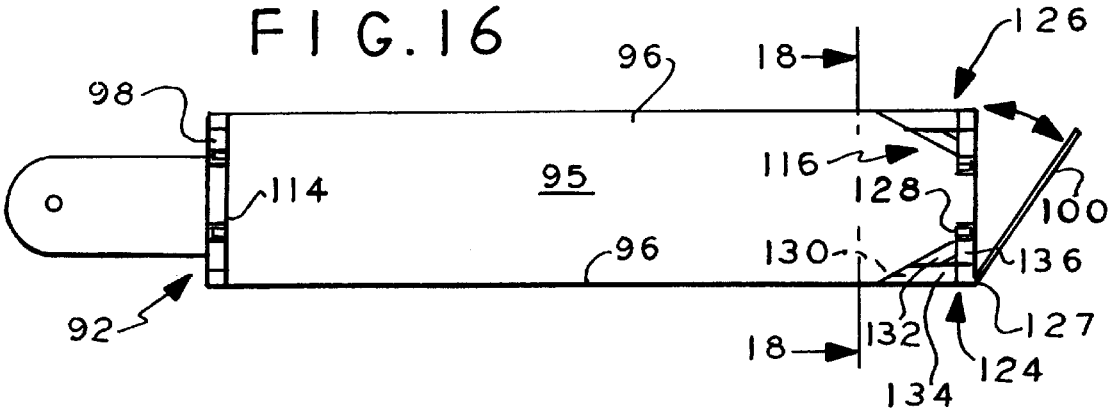
Figure 17:
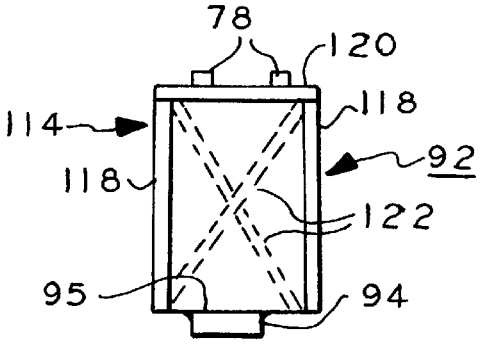
Figure 18:
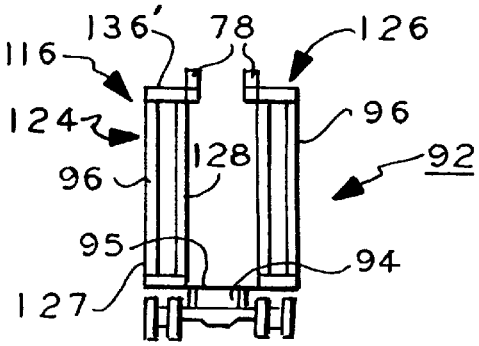

FIG. 14 ;is an isometric view of an alternate embodiment for securing the carrier support to a transport vehicle such as a rail car;

FIG. 15 is a side elevation partially in section view of a truck trailer used for transporting the carrier of FIGS. 3, 4 and 10;

FIG. 16 is a top plan view of the trailer of FIG. 15;

FIG. 17 is a sectional elevation view of the trailer of FIG. 15 taken along lines 17—17; and FIG. 18 is a sectional elevation view of the trailer of FIG. 15 taken along lines 18—18.

Figure 1:
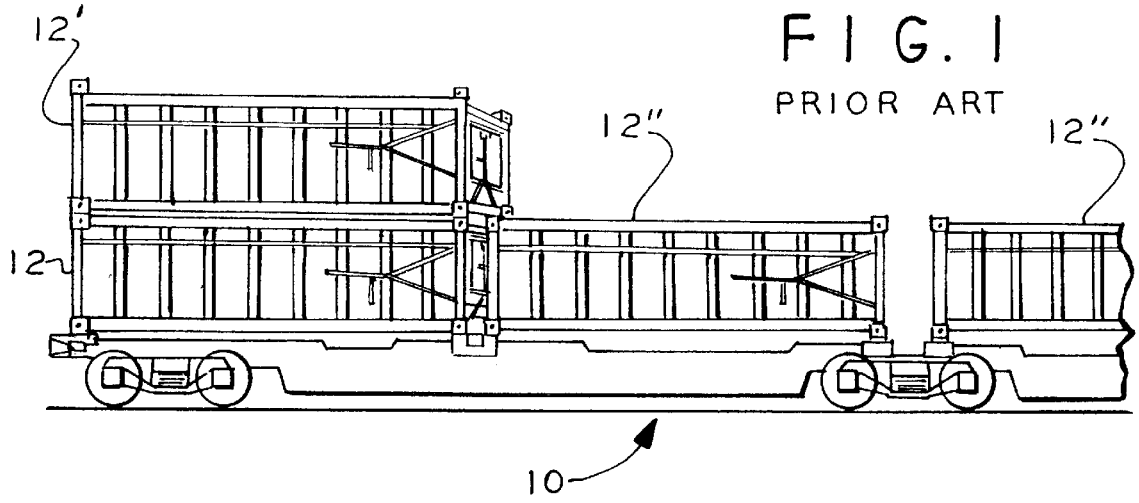
FIG. 1 PRIOR ART
FIG. 1 is a front elevation perspective view of rail cars loaded with prior art presently used bulk storage containers.

In the drawing like reference numerals refer to like parts throughout. In FIG. 1, prior art rail car 10, a flat car, carries a plurality of stacked prior art bulk material storage containers 12, 12', 12" and so on of one configuration. Other containers in wide use (not shown) may be enclosed steel cargo units used for ship, rail and truck transport. Such containers may weight about four tons. The containers 12, 12' and 12" of FIG. 1 are identical with containers 12 and 12" mounted directly on the rail car 10 and container 12' mounted on container 12 in stacked relation. One rail car 10 can carry as many as eight containers 12, 12' and 12", only three being shown in the figure.

Figure 2:
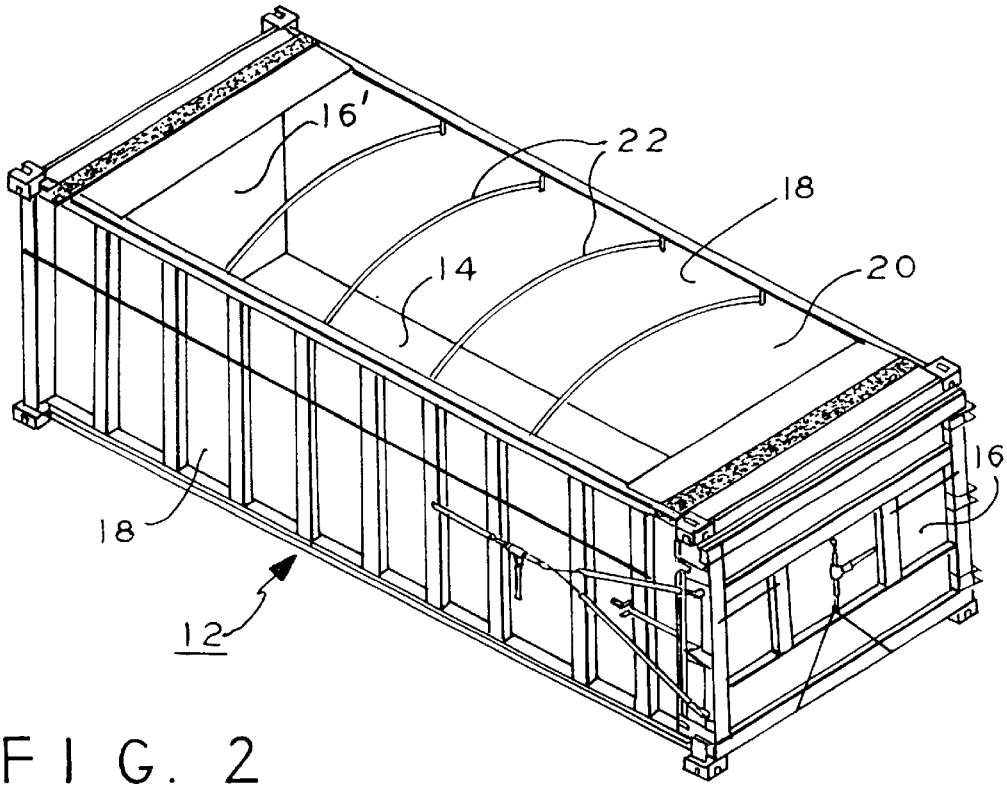
FIG. 2 PRIOR ART
FIG. 2 is a more detailed perspective view of a typical prior art container used in the embodiment of FIG. 1.

In FIG. 2, a representative prior art bulk container 12 is shown. The container 12 comprises a bottom steel wall 14, two steel end walls 16, 16' and two opposing steel side walls 18. These walls form an interior chamber 20. One inch steel bars 22 extend across the chamber and are attached to the side walls 18. The chamber 20 receives bulk material to be transported. The container is about 20 feet in length by 8 feet in width and 6 feet in height.

The container 12 has a 25–33 cubic yard capacity. The end wall 16' comprises a gasketed door 16' for removing the contents of the chamber 20. The container 12 remaining walls are welded at their joints. The container has a net weight of about 5500 lbs. with a maximum net lading of about 44,000 lbs.

In FIGS. 3–5, and 10, bulk material carrier 24 of the present invention comprises a pair of elongated beam supports 26 and 28. Supports 26 and 28 may be identical and comprise tubular steel box beams with a rectangular interior 30 forming a hollow steel beam. This carrier has a net weight of about 2,000 lbs. which is considerably less than the prior art containers. Representative support 28, FIG. 5, has opposing sheet steel top and bottom walls 32 and 34 and opposing sheet steel side walls 36 and 38 and is referred to as a box beam. The support 28 may be conventional tube stock and formed in a conventional manner as known in the steel industry.

A sheet of high density polyethylene (HOPE).forms a sling 40 having opposing edge regions 42 and 44. The sling 40 preferably is formed of material having a thickness of about 0.120 inches. This material is believed to have a tensile strength of about 250 lb/inch. The sling 40 has a length L of about 30–33 feet. This provides an ideal dimension for use with both trailer trucks and gondola rail cars. The supports 26 and 28 have a length greater than length L forming an extension 60 that protrudes beyond the sling 40 at each end a distance d of about 8 to 18 inches.

Figure 5:
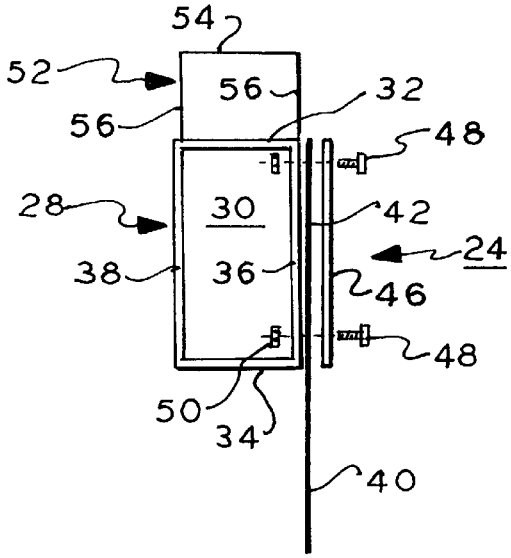
FIG. 5 is an exploded end elevation view of the region 5 in FIG. 4 showing the construction of the carrier of FIG. 3 in which a material carrier sling is clamped to an upper support rail.

In FIG. 5, a steel plate 46 of a suitable thickness, e.g., ¼ to ½ inches according to a given implementation, is bolted to wall 36 of the support 28 by bolts 48 and nuts 50. The plate 46 clamps the edge region 42 of the sling 40 to the support 28. The other opposite edge region 44 of the sling 40 is similarly attached to support 26. Other structures for attaching the sling edge regions may be used in the alternative such as wrapping the sling edge regions about a cylindrical tubular support and clamping the edge regions to the tubular support. It should be understood that the drawings are not to scale and the various relative scales are shown for purpose of illustration only.

Figure 6:
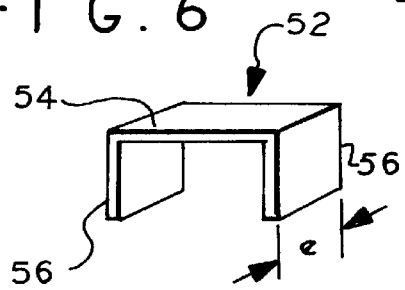
FIG. 6 is an isometric view of a fork lift receiving receptacle used in the carrier of FIG. 3 for lifting and moving the loaded or empty carrier.

A set of two identical receptacle pocket members 52, FIG. 6, are welded or bolted to the top wall 32 of each of the supports 26 and 28. The pocket members 52 comprise a U-shaped member having a top wall 54 made of steel plate and two opposing steel plate side walls 56 about six inches in length e each. The walls 56 are welded or bolted by brackets (not shown) to the top wall 32 of the supports 26 and 28. The pocket members 52 are spaced apart on each support 26 and 28 a distance that corresponds to the spacing of conventional fork lift truck lifting tines (not shown). These tines are used to lift the supports 26 and 28 and the suspended sling 40. In this way the loaded or empty sling can be easily transported to and from rail cars and trucks.

The sling serves primarily as a lifting device for the fungible material being carried thereby. It is intended for use with conventional rail cars and trucks as modified herein and which provide structural support and containment of the load. That is, the sling abuts the rail car or truck floor and side walls to contain and provide support for the sling and its load at the bottom and sides of the sling during transport of the loaded sling. The loaded sling being flexible may conform somewhat to the interior cargo space of the rail car and truck carrying the sling. Thus the bottom and sides of the sling may flatten to conform to the adjacent abutting walls and floors. These abutting walls provide additional structural integrity to the loaded sling during transport.

Figure 7:
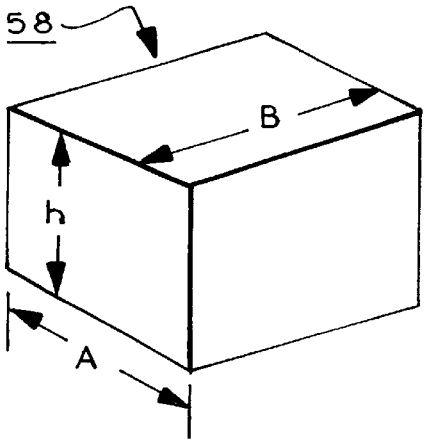
FIG. 7 is an isometric view of one of a plurality of bales of municipal waste that is carried by the carrier of FIG. 4.

In FIG. 7, a representative bale 58 of municipal waste is a block that measures in width A; two to four feet, length B four to six feet and height h of about two to four feet. The width dimension A is about the width of the spacing of the supports 26 and 28 in use for receiving the bales 58 each weighing about 1.5 to 2.5 tons. The sling 40 has a length L of about 30 feet and a height of about 6–9 feet. The sling 40 can hold about 10 bales for a maximum bale weight of about 40,000 to 50,000 lbs. (2–25 tons). In FIG. 4, the bales 58 are shown in phantom stacked in stacks of two along the length of the sling 40.

While HDPE plastic sheet material is preferred, it will occur to one of ordinary skill that other flexible materials of high strength may also be used to form the sling 40. For example, many materials are available with high strength fibers such as Kevlar (a trademark of DuPont Corporation) for a polyamide fiber, carbon fibers and metal fibers, woven or knitted and the like, which may also be formed into a flexible sheet material of high tensile strength for use as a carrier of bulk material such as municipal waste, ash, coal, grain, soil, salt and the like.

Figure 8:
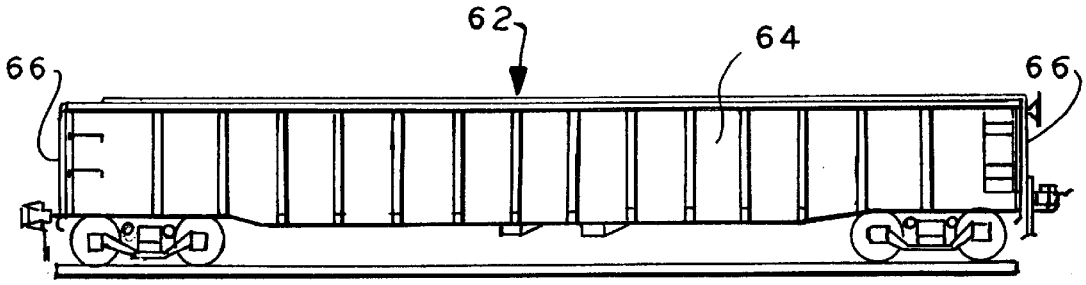
FIG. 8 is a side elevation view of a gondola rail car use to transport a plurality of the carriers of FIG. 4.
Figure 9:
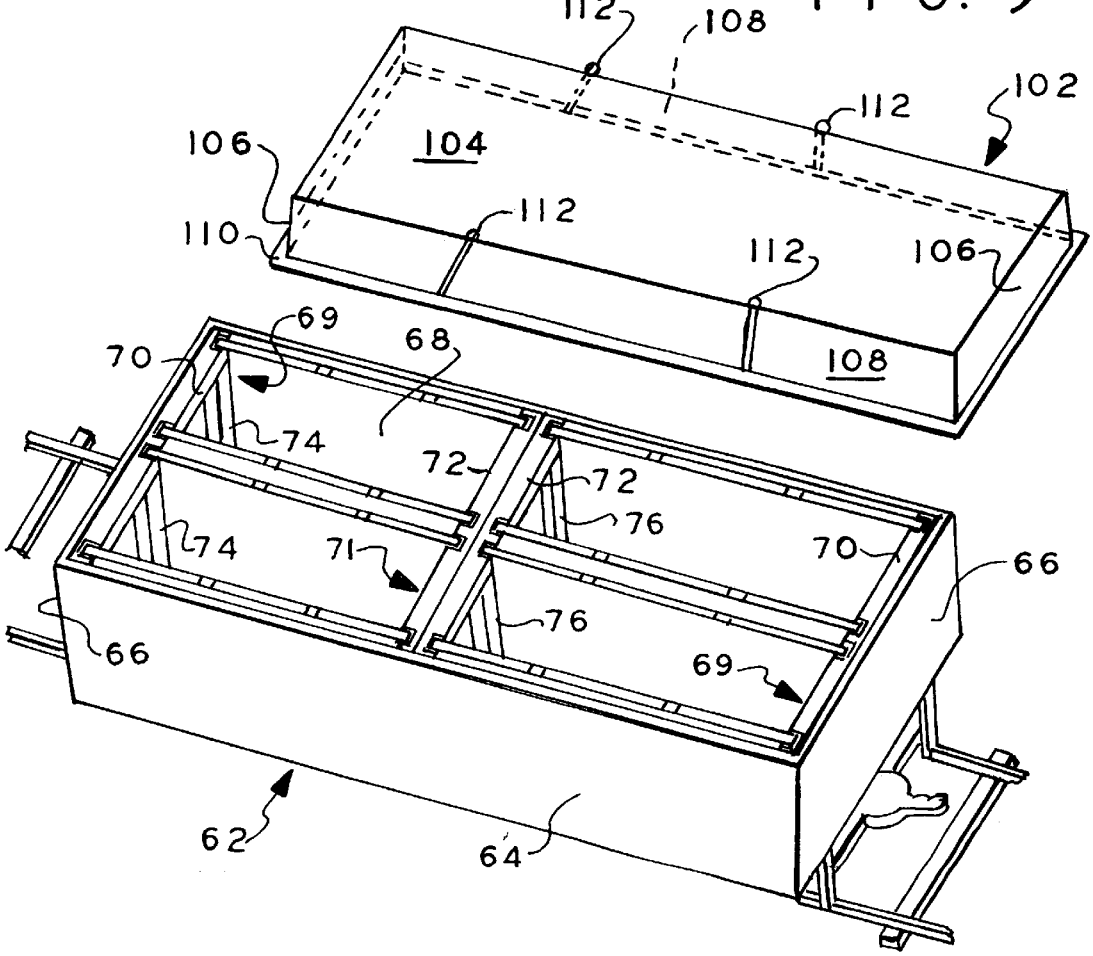
FIG. 9 is an isometric exploded view of the rail car of FIG. 8 modified for carrying a plurality of carriers depicted in FIG. 4.

In FIG. 8, a conventional gondola rail car 62 is modified to transport the carriers 24 of FIG. 3. A gondola rail car 62 is preferred because it is widely available, relatively low in cost, and is readily adapted for use with the carriers 24. In FIG. 9, rail car 62 has conventional side walls 64, end walls 66 and a bottom wall 67 (FIG. 11). The rail car 62 walls form a cargo carrying chamber 68. Typically, chamber 68 is about 66 feet long and about 9 feet wide. The length of such rail cars as available commercially may vary in the range of about 49 to 66 feet. The carriers are thus dimensioned accordingly to mate with the vehicle to be used with that carrier.

The car 62 chamber 68 is fitted with carrier support frames 69 and 71. Frame 69 comprises cross beam 70 and vertical support beams 74, FIGS. 9, 11 and 13. Frame 71 comprises cross beam 72 and vertical support beams 76. Frame 69 is adjacent to each of the end walls 66 and the frames 71 are located medially in the chamber 68. The beams 70, 72 and 74 may be the same dimensions or different dimensions or shapes according to a given implementation, which dimensions and shapes are not critical as long as the beams support the desired loads as described below. These beams may be hollow square steel box beams, tubular circular cylindrical steel beams or steel I-beams. The vertical beams 74 are of any suitable configuration and preferably welded or bolted to the end walls 66, side walls 64 and bottom wall 67 of the rail car and to supporting struts for the walls as applicable. The beams 70 are attached to the top of beams 74 and the beams 72 are attached to the tops of beams 76. The beams 74 may be attached to the side walls 64 by welding or bolting and similarly attached to the bottom wall 67. Gussets (not shown) may also be used to form the frames. The beams 72 are placed across the chamber medially the chamber 68 and attached to the vertical beams 76 by welding or bolting or any convenient securing arrangement. The beams 70 are similarly attached to the tops of beams 74. The beams 70 and 74, and beams 72 and 76, may be prefabricated as subassemblies for installation in the rail car.

In FIGS. 11, 12 and 13, a support receiving and securing receptacle pocket member 78 is secured to beams 70 and 72. The member 78, FIG. 12, comprises a U-shaped structure with a base wall 80 and two parallel side walls 82 attached to the base wall 80 forming a channel receptacle 83. The walls 80 and 82 maybe formed from a bent sheet steel plate or may be formed of separate plates welded together. The pocket member 78 is then welded or bolted by brackets (not shown) to the top of beams 70 and 72. The members 78 are important for securing the carrier 24 supports 26 and 28 to the rail car so that the carrier 24 will not displace horizontally while mounted to the rail car during transporting of the loaded or empty carriers by the rail car or truck. Such transporting induces motions to the rail car or truck which motions should not dislodge the carriers 24, empty or loaded.

In FIG. 14, an alternative embodiment of the carrier support receiving pocket member is shown. In this embodiment, each carrier support 84 which may be a box or I bean, has a recess or through opening 86 at each end, one end being shown. The opening 86 is in the extension of the support such as extension 60 of the FIG. 3 support 26 embodiment.

A projection 88 extends upwardly from a cross beam 90 which is used in place of beams 70 and 72, FIGS. 9 and 11. The projection is received in the opening 86 and matingly engages the opening to secure the support 84 in the horizontal plane during transport of the associated carrier. The projection 85, in the alternative, may comprise a rotatable locking cam (not shown) used to secure intermodal containers to trucks and rail cars in a conventional fashion. Not shown is a further embodiment using both the projection-opening combination of FIG. 14 with the pocket member 78 of FIG. 12.

In FIG. 11, one carrier 24 is shown secured to the rail car. Four carriers 24 may be secured to the rail car 62 in symmetry with the one carrier 24 shown. In FIG. 9 the vertical and cross beams of the frames 69 and 71 are shown level with the top of the rail car. However, as shown in FIG. 13, the frames may also extend above the top of the rail car according to a given implementation. The drawing FIG. 9 is provided to schematically show the elements rather than their exact height relationship in the rail car chamber.

In FIG. 9, a steel or other material lid 102 is attachable to the rail car side and end walls. The lid 102 has a cover 104 and depending sides 106 and 108 which terminate at their lower edges in a peripheral flange 110. The lid is attached to the rail car 62 over the chamber 68 by latches (not shown) or by mating flanges (not shown) which secure the lid in place by its weight. Eyelets 112 are used to lift the lid on and off of the rail car. The lids could be furtrher sec ured by conventional straps, Bungee cords, ratchet operated strap mechanisms, bindings and so on.

In FIGS. 15–18, a truck trailer 92 has a chassis 94 on which is mounted floor 95, side walls 96, front wall 98 and a door 100 at the rear. A front frame 114 is attached to the trailer at the forward end of the chassis 94 and a rear frame 116 is attached to the rear of the chassis 94.

The front frame 114 comprises two vertical beams 118 and a horizontal top beam 120. The beams may be box or I shaped. In addition, a reinforcing strut arrangement comprising cross strut beams 122 (shown in phantom) may be used to reinforce the frame 114 according to a given implementation. Other reinforcing struts may also be used as needed. The frame 114 may be prefabricated and then attached to the truck chassis and walls by welding, brackets and bolts or any other suitable arrangement as known in the truck fabrication industry. Additional struts (not shown) may also be used as needed that extend transversely to the plane of the vertical and horizontal beams in the longitudinal direction (front to rear) of the chassis. The vertical beams are attached to the front and side wall support struts (not shown).

The rear frame 116 comprises two mirror image sections 124 and 126. Section 124 is representative and comprises three vertical beams 127, 128 and 130, box or I shaped. A first set of three horizontal beams 132, 134 and 136 are joined together by welding or by brackets and attached to the floor 95 and/or chassis 94, the latter attachment may be by additional beams (not shown). A set of beams 132', 134' and 136' are attached to the tops of the beams 127, 128 and 130 to complete the section 124. The section 126 is constructed similarly in mirror image fashion.

Receptacle pocket members 78, FIG. 12, are placed on top of beam 120 and on top of frame sections 124 and 126 respective beams 132', 134' and 136' which are vertically aligned on the respective corresponding lower beams 132, 134 and 136. Each section 124 and 126 thus forms a triangular frame of vertical and horizontal beams. The pocket members 78 are spaced apart the same distance whether on the rail car 62, FIG. 11, forming four compartments for respectively receiving four carriers 24 or a single compartment for receiving a single carrier on the truck trailer 92, FIGS. 15–18.

In operation, a carrier 24 is placed either on a truck trailer 92, FIGS. 15–18, with the extensions 60 (FIG. 3) located in the pockets formed by pocket members 78 or on a rail car 62, FIG. 11. In the rail car embodiment, only one carrier 24 is shown. A total of four such carriers can be carried by the rail car 62. The carriers 24 have a length and width such as to fit within the chamber 68 of the rail car in sets of four. Of course if rail cars of other dimensions are desired to be used, the carriers need to be dimensioned accordingly. The pocket members 78 are arranged to cooperate with the supports so that the carrier supports can not move horizontally off of the supporting beams 70 and 72 due to motions of the rail car or truck trailer during transport of the carrier. The carriers may be filled with municipal waste bales or other dry bulk material. Optionally, the ends of the carrier 24 slings 40 may be enclosed with a cover, tail gate or door formed by overlapping flaps hinged to the sling 40 or to the supports 26 and 28. Such a cover may be HDPE or any other suitable material. The cover may be used to retain bulk material that is of the fungible type such as sludge, grain, gravel, salt and the like. In this case, such a cover must be securely attached to retain the bulk material in place. Latches (not shown) or other attachment elements may be used in conjunction with a frame (not shown) attached to the cover and sling for robustly securing the carrier end covers in place and for retaining the bulk material load on the sling 40.

The projections 88, FIG. 14, and mating openings 86 may be used to hold the carriers in place on the rail car in the alternative to the pocket members 78. A fork lift truck (not shown) is used to lift the carrier 24 on and off the truck trailer and rail car. The loaded or empty carrier 24 may be transferred from and to the rail car and truck. The supports 26 and 28 mate with the pocket members 78 on the truck trailer 92 conveniently and easily. The carrier once loaded onto the truck trailer remains fixed in position by the pocket members. The truck trailer is one of the appropriate dimensions for receiving the carrier 24. Such a trailer is one that is typically 33–40 feet in length. The trailer door 100 is used to access the trailer compartment with or without the carrier in place.

While certain constructions have been shown, it will occur to one of ordinary skill that various modifications may be made to the disclosed embodiments which are given by way of example and not limitation. Various materials and dimensions are exemplary and not limiting. The shapes and functions of various components may be different than the disclosed embodiments according to a given implementation.

It is intended that the scope of the invention is as defined in the appended claims.

What is claimed is:

1. A bulk material transport system for transporting bulk material on at least one transport vehicle arranged for being moved as a self propelled motorized vehicle comprising;

at least one carrier supporting frame adapted to be permanently secured to the at least one transport vehicle; and a bulk material carrier for receiving the bulk material to be transported by the at least one transport vehicle;

the carrier comprising a pair of elongated supports, each support having opposing first and second ends for mounting on the at least one frame, and a flexible sheet material forming a sling having opposing edge regions;

the supports being secured to the sling at the opposing edge regions, the support ends and support frame being arranged to releasably mate for releasably securing the sling suspended in fixed position to the frame at said support ends to preclude horizontal displacement of the secured supports relative to the at least one frame during transport of the loaded carrier.

2. The system of claim 1 wherein the at least one vehicle comprises a rail car and a truck each having a cargo receiving body, the at least one support frame comprising a first frame for attachment to the rail car body and a second frame for attachment to the truck cargo body, the frames each being arranged to receive and secure the pair of supports and sling.

3. The system of claim 2 wherein the first and second frames are different.

4. The system of claim 2 wherein the first and second frames each include a cross member having an identical support receiving element for restraining the horizontal displacement of the received support.

5. The system of claim 1 wherein the supports are hollow beams having a first length, the sling having a second length shorter than the first.

6. The system of claim 1 wherein the supports have the same end configuration, the frames including a pocket member mating with and for receiving the end configuration of said supports to preclude said horizontal displacement.

7. The system of claim 1 wherein the frame comprise a cross member for receiving thereon the ends of the supports and for supporting the ends by the force of gravity, further including an element protruding from the cross member for receiving at least a portion of the support ends and for restraining the supports from displacement in a horizontal plane.

8. The system of claim 6 wherein the element comprises a U-shaped member having a plurality of sides forming a pocket for receiving mating engaged end of a support.

9. The system of claim 7 wherein the element comprises one of a projection extending from the cross member and aperture in the cross member, the ends each having the other of the projection and aperture for receiving and engaging the projection vertically.

10. The system of claim 1 wherein the supports comprise tubular members with planar sides normal to adjacent sides, a plate, and a plurality of fasteners for attaching the plate to one of said planar sides with the sheet material of the sling sandwiched between the plate and the one side.

11. The system of claim 1 wherein the at least one transport vehicle comprises a rail car, the frame comprising a plurality of spaced cross members on which the ends of said supports can be mounted for dividing the rail car into a plurality of carrier receiving compartments, each compartment for receiving a different corresponding bulk material carrier.

12. The system of claim 11 wherein the at least one carrier supporting frame is arranged for dividing the rail car into four compartments, each for independently receiving a bulk material carrier.

13. The system of claim 1 wherein said supports each having a pair of pocket members for releasably receiving a fork lift vehicle lift member to lift the carrier off of the at least one frame.

14. The system of claim 1 wherein the sheet material forming the sling is high density polyethylene having a tensile strength of about at least 250 lb/in$^2$.

15. The system of claim 1 wherein the carrier and frame are arranged to carry at least about 40,000 lb. of bulk material.

16. A bulk material transport system for transporting bulk material on a rail car and on a truck transport vehicle and for transferring the bulk material from one to the other of said rail car and truck transport vehicle, each said rail car and truck transport vehicle being arranged to be transported by a self propelled motorized vehicle, comprising;

a first support frame for being permanently secured to the rail car;

a second support frame for being permanently secured to the truck vehicle; and a bulk material carrier comprising a flexible sheet material suspended from a pair of spaced elongated supports and forming a sling having opposing edge regions at which the supports are secured, the sling for receiving the bulk material, each support having opposing first and second ends, the support ends for releasable selective mating with and supported by said first and second frames, the frames and ends being arranged for releasably securing the supports in fixed position to the frames to preclude horizontal displacement of the secured supports relative to the frames.

17. A bulk material transport system for transporting bulk material on a rail car and on a truck transport vehicle and for transferring the bulk material from one to the other of said rail car and truck transport vehicle, each said rail car and truck transport vehicle being arranged to be transported by a self propelled motorized vehicle, comprising;

a pair of support frames for being permanently secured to a truck or rail car; and a bulk material carrier comprising a flexible sheet material suspended from a pair of spaced elongated supports and forming a sling having opposing edge regions at which the supports are secured, the sling for receiving the bulk material, each support having opposing first and second ends, the support ends for releasable selective mating with and supported by said support frames, the frames and first and second ends being arranged for releasably securing the supports in fixed position to the frame.

18. A bulk material transport system for transporting bulk material on at least one transport vehicle comprising;

at least one carrier supporting frame adapted to be permanently secured to the at least one transport vehicle; and a bulk material carrier for receiving the bulk material to be transported by the at least one transport vehicle;

the carrier comprising a pair of elongated supports, each support having opposing first and second ends for mounting on the at least one frame, and a flexible sheet material forming a sling having opposing edge regions;

the supports being secured to the sling at the opposing edge regions, the ends of the supports and support frame being arranged to releasably mate for releasably securing the sling suspended in fixed position to the frame to preclude horizontal displacement of the secured supports relative to the at least one frame during transport of the loaded carrier;

the supports comprising hollow beams having a first length, the sling having a second length shorter than the first length, the supports for protruding beyond the sling at each said ends for releasable mounting on said at least one frame at each said ends.

19. A bulk material transport system for transporting bulk material on at least one transport vehicle comprising;

at least one carrier supporting frame adapted to be permanently secured to the at least one transport vehicle; and a bulk material carrier for receiving the bulk material to be transported by the at least one transport vehicle;

the carrier comprising a pair of elongated supports, each support having opposing first and second ends for mounting on the at least one frame, and a flexible sheet material forming a sling having opposing edge regions;

the supports being secured to the sling at the opposing edge regions, the ends of the supports and support frame being arranged to releasably mate for releasably securing the sling suspended in fixed position to the frame to preclude horizontal displacement of the secured supports relative to the at least one frame during transport of the loaded carrier;

the frame comprising a cross member for receiving thereon the ends of the supports and for supporting the ends by the force of gravity, further including an element protruding from the cross member for receiving at least a portion of the support ends and for restraining the supports from displacement in a horizontal plane.

20. A bulk material transport system for transporting bulk material on at least one transport vehicle comprising;

at least one carrier supporting frame adapted to be permanently secured to the at least one transport vehicle; and a bulk material carrier for receiving the bulk material to be transported by the at least one transport vehicle;

the carrier comprising a pair of elongated supports, each support having opposing first and second ends for mounting on the at least one frame, and a flexible sheet material forming a sling having opposing edge regions;

the supports being secured to the sling at the opposing edge regions, the ends of the supports and support frame being arranged to releasably mate for releasably securing the sling suspended in fixed position to the frame to preclude horizontal displacement of the secured supports relative to the at least one frame during transport of the loaded carrier;

the at least one transport vehicle comprising a rail car, the frame comprising a plurality of spaced cross members on which the ends of said supports can be mounted for dividing the rail car into a plurality of carrier receiving compartments, each compartment for receiving a different corresponding bulk material carrier.

21. A bulk material transport system for transporting bulk material on at least one transport vehicle arranged as a self propelled motorized vehicle comprising;

at least one carrier supporting frame adapted to be permanently secured to the at least one transport vehicle; and a bulk material carrier for receiving the bulk material to be transported by the at least one transport vehicle;

the carrier comprising a pair of elongated supports, each support having opposing first and second ends for mounting on the at least one frame, and a flexible sheet material forming a sling having opposing edge regions;

the supports being secured to the sling at the opposing edge regions, the supports and support frame being arranged to releasably mate for releasably securing the sling suspended in fixed position to the frame to preclude horizontal displacement of the secured supports relative to the at least one frame during transport of the loaded carrier;

the supports comprising tubular members with planar sides normal to adjacent sides, a plate, and a plurality of fasteners for attaching the plate to one of said planar sides with the sheet material of the sling sandwiched between the plate and the one side.

22. A bulk material transport system for transporting bulk material on at least one transport vehicle arranged as a self propelled motorized vehicle comprising;

at least one carrier supporting frame adapted to be permanently secured to the at least one transport vehicle; and a bulk material carrier for receiving the bulk material to be transported by the at least one transport vehicle;

the carrier comprising a pair of elongated supports, each support having opposing first and second ends for mounting on the at least one frame, and a flexible sheet material forming a sling having opposing edge regions;

the supports being secured to the sling at the opposing edge regions, the supports and support frame being arranged to releasably mate for releasably securing the sling suspended in fixed position to the frame to preclude horizontal displacement of the secured supports relative to the at least one frame during transport of the loaded carrier;

the at least one vehicle comprising a rail car and a truck each having a cargo receiving body, the at least one support frame comprising a first frame for attachment to the rail car body and a second frame for attachment to the truck cargo body, the frames each being arranged to receive and secure the pair of supports and sling;

the first and second frames each including a cross member having an identical support receiving element for restraining the horizontal displacement of the received support.

* * * * *

UNITED STATES PATENT AND TRADEMARK OFFICE

CERTIFICATE OF CORRECTION

PATENT NO. : 6,523,482 B2
DATED : February 25, 2003
INVENTOR(S) : Thomas A. Winant It is certified that error appears in the above-identified patent and that said Letters Patent is hereby corrected as shown below:

Title page,
Item [76], inventor's name should read:

-- Thomas A. Winant --

Signed and Sealed this

Twenty-second Day of July, 2003

JAMES E. ROGAN
*Director of the United States Patent and Trademark Office*